United States Patent [19]

Kitano

[11] Patent Number: 4,465,558

[45] Date of Patent: Aug. 14, 1984

[54] COKE GUIDE CAR HAVING LOAD DISTRIBUTING STRUCTURE

[75] Inventor: Yoshiteru Kitano, Tokyo, Japan

[73] Assignee: Koritsu Machine Industries Limited, Tokyo, Japan

[21] Appl. No.: 525,493

[22] Filed: Aug. 22, 1983

[51] Int. Cl.[3] ..... C10B 33/14; C10B 43/02; C10B 45/00

[52] U.S. Cl. ..... 202/262; 202/270

[58] Field of Search ..... 202/241, 248, 262, 263, 202/270

[56] References Cited

U.S. PATENT DOCUMENTS

| | | | |
|---|---|---|---|
| 3,436,316 | 4/1969 | Lorrek | 202/262 |
| 3,844,900 | 10/1974 | Schulte | 202/262 |
| 4,026,768 | 5/1977 | Bahnsch et al. | 202/262 |
| 4,347,105 | 8/1982 | Kwasnik et al. | 202/262 |

*Primary Examiner*—Bradley Garris

*Attorney, Agent, or Firm*—Holman & Stern

[57] ABSTRACT

Total load distribution of coke guide cars can be substantially evenly effected in accordance with the present invention which comprises a pair of parallel beams whose inner portions are positioned under and perpendicular to upper beams of the guide car and outer portions are bent down at a slant and extend to a third rail laid outside of a quencher track, a plurality of girders mounted between and spanning the horizontal portions of the parallel beams, plural pairs of rails mounted under the girders and adapted to hang main instruments of the guide car, and pairs of fitting plates hung from the upper beams and to which the inner portions of the parallel beams are jointed by means of joint pins.

1 Claim, 4 Drawing Figures

COKE GUIDE CAR HAVING LOAD DISTRIBUTING STRUCTURE

BACKGROUND OF THE INVENTION

This invention relates to a body structure of coke guide cars. Heretofore, the load distribution of a coke guide car has been such that the load is imposed on a pair of rails laid on a platform in front of a coke oven battery, while, a so-called third rail laid outside of a quencher track merely props up about a half load of a coke dust collecting hood which is mounted projecting over the quencher track from the coke guide car.

Further, with the prior art coke guide car whose main instruments, viz., a door lifter, a coke guide cage, a jam cleaner and a coal dust collecting hood are installed on a base carriage, there has been involved such defects that, when the above instruments other than the hood are moved to and fro relative to the coke oven for guiding extruded coke, their loads are directly imposed on the to-and-fro wheels of the base carriage and rails therefor with such difference as depending upon the degree of movement to result in unbalance of the load distribution and this unbalance disturbs smooth running of the coke guide car, excessively wears down wheels and rails and thus promotes zigzag running.

SUMMARY OF THE INVENTION

Accordingly, it is an object of the present invention to improve the body structure of the coke guide car so that the total loads of the guide car including the hood may be substantially equally imposed on the above three rails to avoid the excessive wear of the wheels and rails and the zigzag running of the guide car. The improvement characteristically comprises a pair of parallel beams whose inner portions are positioned under and perpendicular to upper beams of the guide car and outer portions are bent down at a slant and extend to a third rail laid outside of a quencher track, a plurality of girders mounted on and spanning the horizontal portions of the parallel beams, plural pairs of rails mounted under the girders and adapted to hang main instruments of the guide car, and pairs of fitting plates hung from the upper beams and to which the inner portions of the parallel beams are jointed by means of joint pins.

BRIEF DESCRIPTION OF THE DRAWINGS

In order that the present invention may be more fully understood, an embodiment in accordance therewith will now be described with reference to the accompanying drawings, in which.

DESCRIPTION OF PREFERRED EMBODIMENT

Figure 1:
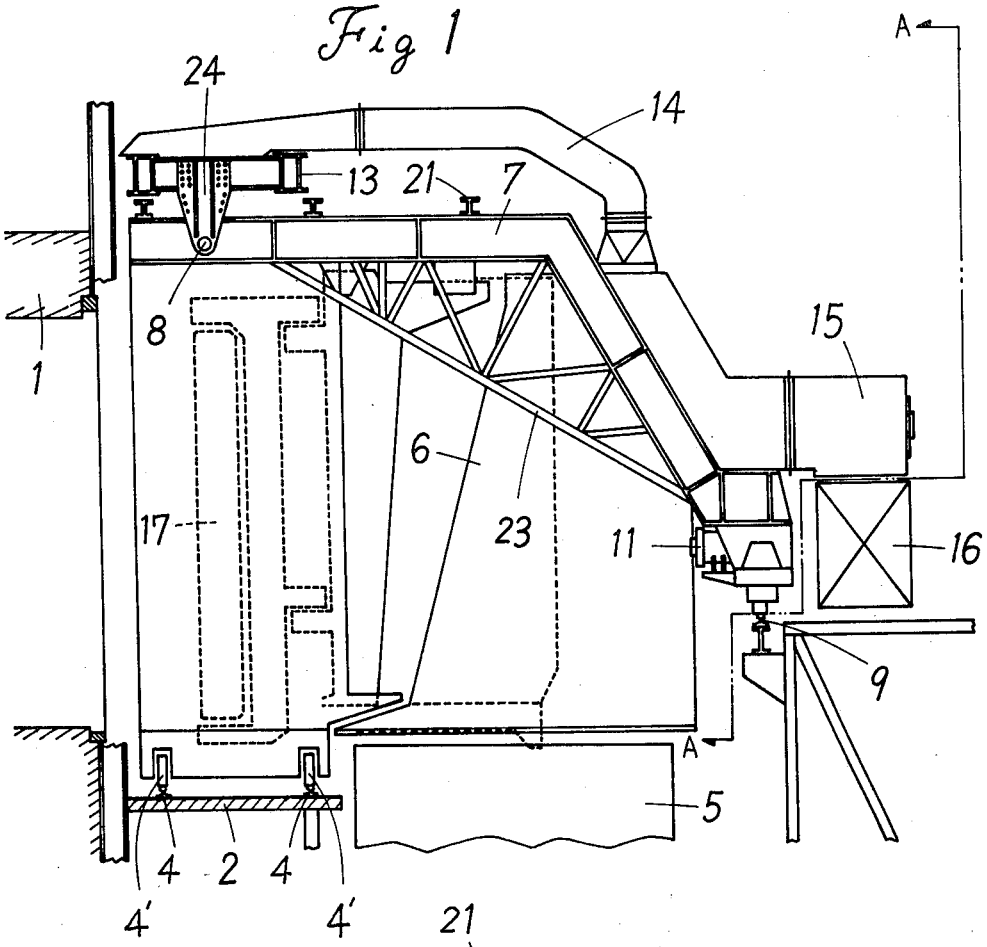
FIG. 1 is a side view of a guide car in accordance with the present invention.

Referring to FIG. 1, a pair of rails 4, 4 are laid on a platform 2 in front of a coke oven battery 1, and there is arranged a base carriage 3 of a coke guide car which runs on the rails 4, 4 with its wheels 4', 4' riding thereon.

Figure 3:
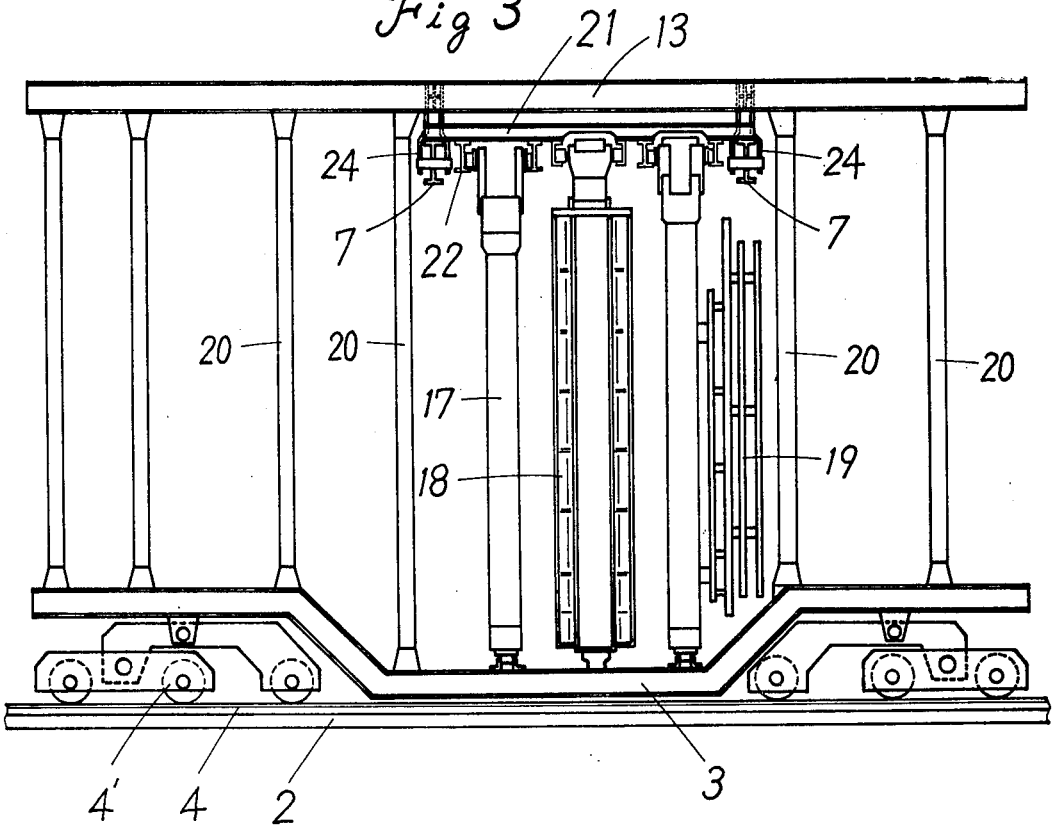
FIG. 3 is a front view illustrating the fitting condition of main instruments.
Figure 4:
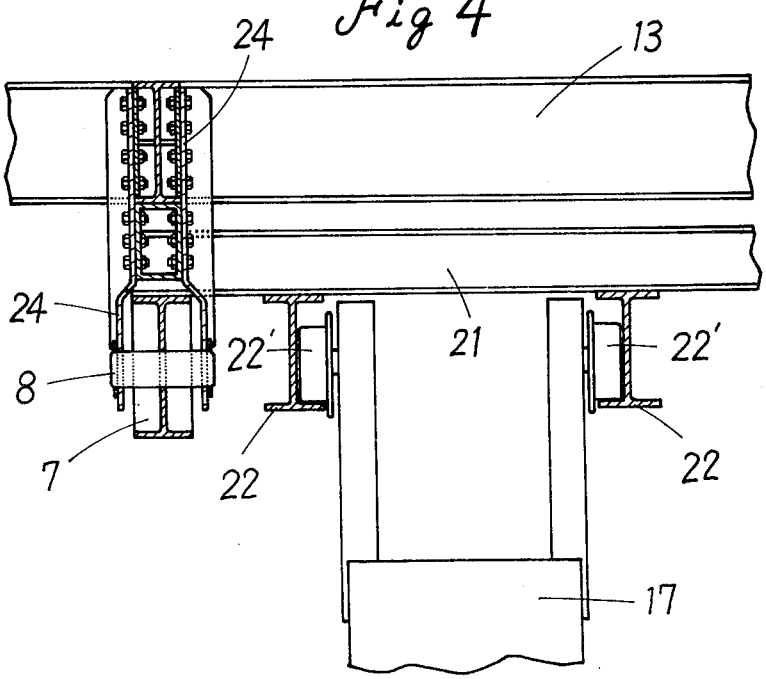
FIG. 4 is an enlarged sectional view of a pin-joint portion.

Next referring to FIG. 3, a pair of upper beams 13 are horizontally mounted spanning over both side vertical pillars 20 which are fixed at the base carriage 3. The upper beams 13 are parallel to the coke oven battery 1 as shown in FIG. 1. There are hung a pair of parallel beams 7, 7 respectively under the upper beams 13,13. The inner portions (left portions in FIG. 1) of the parallel beams 7, 7 are horizontal, while, the outer portions (right portions in FIG. 1) which are bent down at a slant and extend to a third rail 9 laid outside of a track for a quencher 5 are provided at outer ends with wheels 12 that ride on the third rail 9.

Figure 2:
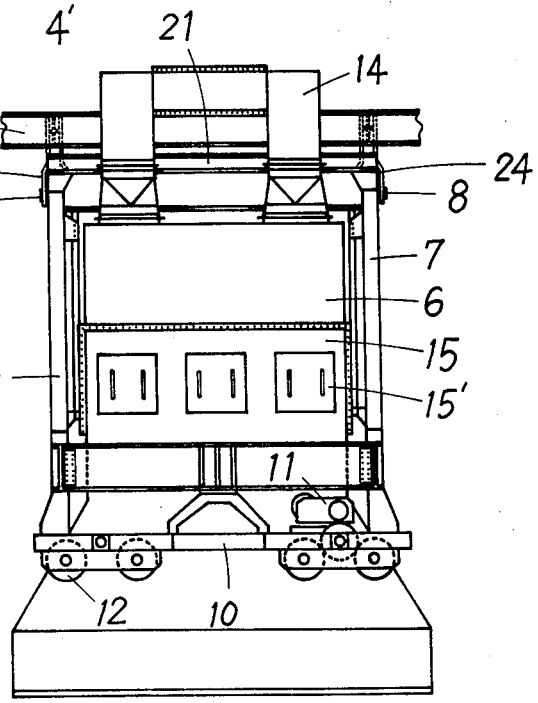
FIG. 2 is a front view of the same taken along line A—A in FIG. 1.

As shown in FIGS. 2 and 3, there are mounted a plurality of girders 21 on and spanning the horizontal portions of the parallel beams 7, 7, and three pairs of hanging rails 22 are mounted under and laterally of the girders 21. The three pairs of hanging rails 22 respectively hang a coke oven door lifter 17, a coke guide cage 18, and jam cleaner 19 laterally movable by means of rollers 22', while, the girders 21 hold and hang a coke dust collecting hood 6.

A fitting hole (not shown) is formed on each of the inner portions of the parallel beams 7, 7 and the inner portions are each jointed by means of a pin 8 to a pair of fitting plates 24, 24 which are suspended by the upper beams 13. In the figures, the reference numeral 10 denotes a saddle, 11 a motor, 14 ducts, 15 connectors, 15' covers, 16 a main duct and 23 auxiliary supports.

As described above, the door lifter and the other main instruments to be installed on the coke guide car are all hung by the pairs of rails from the girders 21, which are supported by the parallel beams 7, 7, and the latter parallel beams 7,7 are each jointed by means of the pin 8 to the fitting plates 24 which are per se hung from the upper beams 13. Accordingly, by changing the position of the fitting plates 24, 24, the distribution of total load of the guide car including the coke dust collecting hood 6 to the rails 4, 4 and the third rail 9 can be properly changed. Further, by hanging the above main instruments other than the hood from the girders 21, the variation of the load distribution due to the to-and-fro movement thereof can be largely moderated, and by properly selecting the position of the joint pin 8, there can be substantially evenly distributed the total load of the guide car to the wheels 4', 4' on the rails 4, 4 and wheels 12 on the third rail 9.

Thus, the present invention provides such advantages that the coke guide car can be smoothly operated without zigzag running and the total load of the guide car can be substantially evenly distributed to all the wheels and rails without wearing partial wheels and rails, since the problem of unbalanced load distribution to the rails and wheels which has been involved in the prior art can now be solved by hanging the main instruments of the coke guide car from the girders and jointing the inner portions of the parallel beams to the fitting plates by means of the joint pins.

What is claimed is:

1. In an arrangement having a coke guide car comprising a base carriage which runs with its wheels riding on a pair of rails laid on a platform in front of a coke oven battery, vertical pillars fixed at the base carriage and a plurality of upper beams horizontally mounted to and spanning over the vertical pillars, the improvement which comprises:

a pair of parallel beams whose inner portions are horizontal and positioned under and perpendicular to the upper beams and whose outer portions are bent down at a slant and extent to a third rail laid outside of a quencher track to ride thereon by means of wheels therefor;

a plurality of girders mounted between and spanning the horizontal portions of the parallel beams;

plural pairs of rails mounted under the girders and adapted to hang a door lifter, a coke guide cage, a jam cleaner, and a coke dust collecting hood of the coke guide car; and pairs of fitting plates hung from the upper beams and to which the inner portions of the parallel beams are jointed by means of joint pins and wherein the positions of said fitting plates and joint pins are capable of being changed in a manner to evenly distribute the total load of the guide car.

* * * * *